US005823262A

United States Patent [19]

Dutton

[11] Patent Number: 5,823,262

[45] Date of Patent: Oct. 20, 1998

[54] CORIOLIS PUMP-OFF CONTROLLER

[75] Inventor: Robert E. Dutton, Louisville, Colo.

[73] Assignee: Micro Motion, Inc., Boulder, Colo.

[21] Appl. No.: 629,805

[22] Filed: Apr. 10, 1996

[51] Int. Cl.[6] ..... E21B 43/12; E21B 47/00; E21B 47/10

[52] U.S. Cl. ..... 166/250.15; 166/53; 166/68.5; 166/91.1; 166/369; 73/152.61; 417/36

[58] Field of Search ..... 166/250.01, 250.08, 166/250.15, 267, 369, 370, 53, 66, 68.5, 86.1, 91.1, 105; 73/152.29, 152.32, 152.61; 417/36

[56] References Cited

U.S. PATENT DOCUMENTS

| | | | |
|---|---|---|---|
| Re. 34,111 | 10/1992 | Wynn | 166/53 |
| 4,232,736 | 11/1980 | Pillette | 166/53 |
| 4,633,954 | 1/1987 | Dixon et al. | 166/53 X |
| 4,738,313 | 4/1988 | McKee | 166/53 X |
| 4,854,164 | 8/1989 | Rhoads . | |
| 5,064,349 | 11/1991 | Turner et al. | 417/36 |
| 5,146,991 | 9/1992 | Rogers, Jr. | 166/53 X |
| 5,316,085 | 5/1994 | Dawson | 166/53 X |

*Primary Examiner*—George A. Suchfield
*Attorney, Agent, or Firm*—Duft, Graziano & Forest, P.C.

[57] ABSTRACT

The operation of an oil well pumping unit control system (20, 200) is governed by a computerized automated control unit (88) that receives flow rate measurements from a Coriolis flow meter (28). The control unit causes production from a beam pumping unit (22) to cease when measurements from the Coriolis flow meter indicate a decline in the pump efficiency. The decline in pump efficiency indicates that a production fluid level (136) in the production tubing (108) has fallen below the uppermost point of travel for the plunger (122). Production from the well is, accordingly, shut-in to afford the reservoir sufficient time to build the pressure and corresponding fluid level that is required to recommence production operations.

22 Claims, 6 Drawing Sheets

FIG. 4
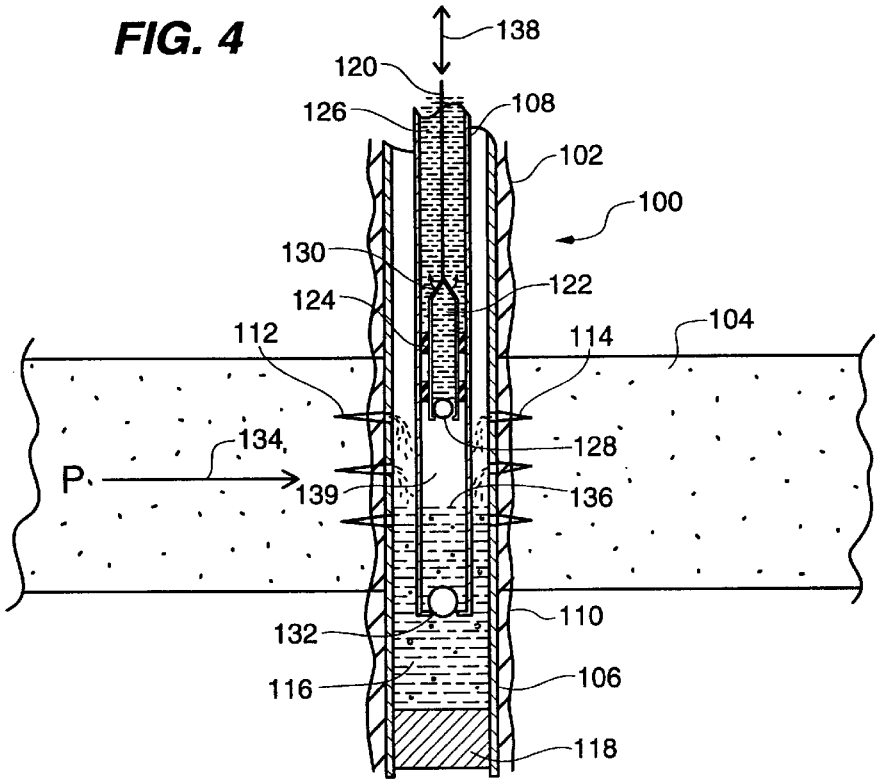
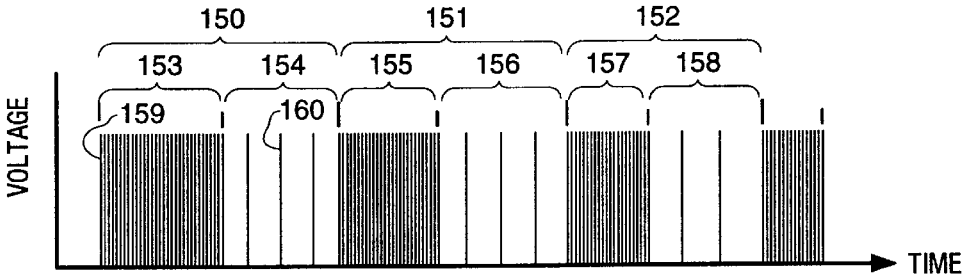
FIG. 5
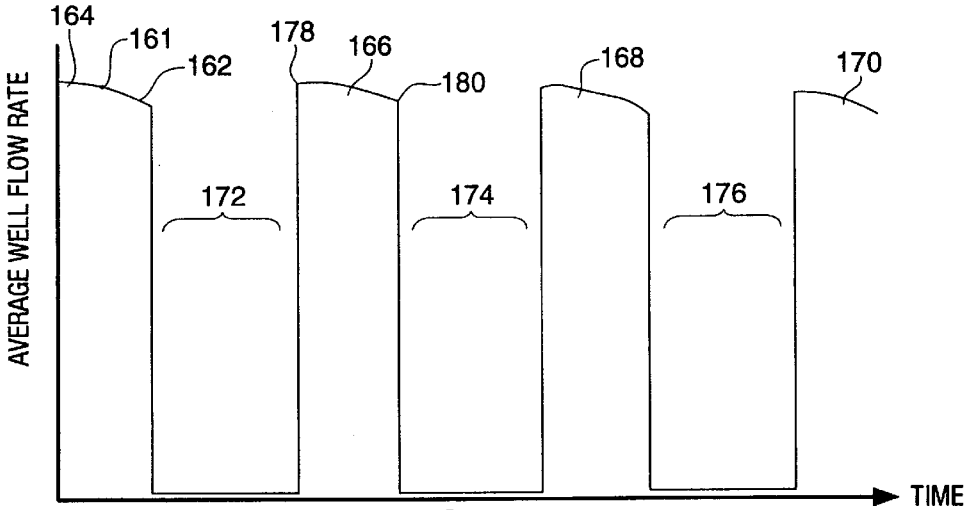
FIG. 6

CORIOLIS PUMP-OFF CONTROLLER

BACKGROUND OF THE INVENTION

1. Field of the Invention

The present invention pertains to the field of control systems for pumping units that lift oil well production fluids from rock formations beneath the earth's surface. More specifically, the control system is a pump-off controller for a beam-type pumping unit that ceases production when production fluids in the well bore are disadvantageously low.

2. Statement of the Problem

Oil is produced from well bore holes that reach deep beneath the surface of the earth to drain production fluids from naturally occurring reservoirs or structural traps in rock formations. The reservoirs characteristically have porosity (void spaces within this rock) and permeability (a capacity to flow fluids). The pressure at the reservoir in a specific well is known in the art as the bottom hole pressure. Virgin reservoirs typically have an initial bottom hole pressure ranging from about 0.4 to 0.5 psi per foot of depth; however, variations are known to occur outside this range. Bottom hole pressure continually declines over the life of a producing well because production fluids are constantly being removed from the reservoir. Production fluids typically contain oil, water, and natural gas.

Producing well bottom hole pressures are difficult to predict and control because many variables are involved. A very general explanation of pressure drawdown is that the bottom hole pressure of a well differs from an average pressure in the reservoir according to a mathematical flow relationship known as Darcy's law, reservoir geometry, material balance considerations, production fluid properties (e.g., compressibility and viscosity), and rock properties (e.g., compressibility, porosity and permeability). A nonlinear pressure gradient exists along a radius taken from the well bore out into the reservoir. The pressure gradient increases with the rate of production from the well. Proximity to other wells and to geologic features defining reservoir boundaries also increase the rate of pressure drawdown for a particular well.

Pressure depletion of an oil reservoir is often a significant problem that must be carefully managed to optimize the economic performance of an oil reservoir. The problem arises when the available bottom hole pressure falls below a value that is required to overcome the hydrostatic head in the well bore. For example, a well that is eight thousand feet deep can have a bottom hole pressure of 3000 psi. Where production fluids originating from the well have a density yielding a combined pressure gradient of 0.4 psi per foot of depth, a bottom hole pressure of 3200 psi (8000 feet times 0.4 psi per foot) would be required to bring the production fluids to the surface. On the other hand, the available reservoir energy or pressure is only able to lift the fluids to 7500 feet (3000 psi divided by 0.4 psi per foot). The well cannot produce a naturally occurring flow, and must be abandoned unless an artificial lift device can be installed to bring production fluids to the surface. Artificial lift devices are installed to rejuvenate falling production rates, and permit the additional recovery of large amounts of oil reserves from partially depleted reservoirs.

Beam type pumping units are the most commonly used type of artificial lift device. In beam pumping units, a beam is connected to a drive mechanism, a fulcrum, and a counterweight system, as well as a subsurface rod and plunger assembly that reaches to the producing reservoir. The rod and plunger assembly fits within a production tubing string that is used to carry production fluids to the surface. Rocking of the beam at the fulcrum causes the subsurface rod and plunger assembly to shift up and down over a path that typically ranges up to about eight feet or more. Near the bottom of the well bore, a valve system in the plunger closes on the upstroke to lift a column of fluid towards the surface. The valve system opens on the downstroke to permit additional fluid entry into the tubing string column for lifting, and again closes on the subsequent upstroke to seal production fluids in the tubing string during lifting. The valves that cooperate to perform this opening and sealing functions are respectively known in the art as a standing valve, a traveling valve, and a check valve.

A problem that is known as 'pump-off' often occurs when beam pumping units are installed in substantially depleted reservoirs. Pressure depleted reservoirs and those having very low permeabilities are often incapable of supplying production fluids at a rate that is sufficient to meet or exceed the rate at which a beam pumping unit withdraws production fluids from the well bore. Thus, the volume of fluid in the well bore steadily declines until the plunger on its upstroke rises up past the level of fluid that the reservoir is capable of supplying to the well bore. In this state, the well is said to be at least partially 'pumped-off' because the plunger is only capable of refilling itself by passing on the downstroke through a column of fluid. The pumped-off plunger on its downstroke cannot fill itself until it again passes beneath the well bore fluid level. Accordingly, energy is wasted by reciprocating a column of liquid with a reduced rate of fluid recovery at the surface, i.e., the lifting efficiency of the pump declines as a consequence of pump-off. The plunger on its downstroke also impacts the fluid with a water hammer or fluid pounding effect traveling up the rod assembly and to the surface beam pumping unit. The pounding effect becomes progressively worse as the fluid level continues to fall because the plunger speed increases at the point of impact. If repeated over a prolonged period, the pounding effect induces fatigue with the corresponding failure of system components. The threaded linkages between the pump rods in the rod and plunger assembly are especially vulnerable to fatigue failure induced by pump-off.

Detection of a pumped-off condition is difficult because the rod and plunger assemblies reach down for great distances, e.g., five to nine thousand feet. At these distances significant elastic stretching occurs in the pump rod string due to the modulus of elasticity in the materials that form the pump rods. The rate of surface reciprocation must, accordingly, be timed to afford the pump rods an opportunity to deliver an optimal reciprocating stroke as the rods stretch over great distances. In practice, this timing procedure is fine tuned by trial and error by experienced field personnel. The pump rods also contact the sides of the production tubing string. Thus, a pumped-off condition cannot always be detected by mere surface vibrations.

Problems arising from a pumped-off condition are resolved by shutting the pump off for a temporary cessation in production from the well, i.e., according to industry terminology, the well is 'shut-in' or 'idled.' The shut-in well builds bottom hole pressure as fluids flow within the reservoir to substantially reduce the pressure gradient between average reservoir pressure and the bottom hole pressure of the well. Production ideally commences at a time after the increased bottom hole pressure raises the fluid level in the well to a level above the uppermost point of travel for the plunger assembly. The well is again shut-in after a time to avoid establishing a pumped-off condition. Significant differences in production rates can be obtained by changing the parameters of the shut-in cycle and the production cycle, i.e., by varying the rate at which the pump beam reciprocates, by varying the length of time that the pump is operating, and by varying the shut-in or idle time.

One traditional method of identifying a pumped-off condition is to place a strain gauge on a portion of the pumping unit that is known as the walking beam. Alternatively, a load cell is placed on a portion of the pump rod assembly known as the polished rod, i.e., the uppermost pump rod. Measurements are plotted on cards depicting polished rod load on the vertical axis and polished rod position on the horizontal axis. These cards are known in the art as dynamometer cards. FIG. 1 depicts a conventional dynamometer card of this type. Variations of FIG. 1 exist in which the data is plotted as a system of dimensionless numbers. The FIG. 1 curve has a well-developed substantially rhomboid shape with good separation between its upper and lower limits showing that the pump is operating very well. FIG. 2 depicts a second dynamometer card showing the effects of fluid pound due to the establishment of a pumped-off condition in the well bore. The upper and lower curves are no longer well separated. The lower curve has a sharp 90° bend at 70% of the downstroke indicating fluid pound.

Many problems are associated with the use of dynamometers to detect fluid pound. Several variables affect the loading of the polished rod or walking beam, and their effects can nullify or add to one another. The effects can also be shifted timewise due to stretching of the pump rod assembly. Therefore, dynamometer readings sometimes cannot be interpreted to identify when pump-off has occurred. Additionally, the strain gauges, load cells, and electronic systems that support them sometimes fail rendering the dynamometer system useless.

An attempt has been made to detect the pump-off problem through the use of volumetric measurements. An extremely complicated apparatus is required, and at the present time volumetric measurements are not commonly used for pump-off control in actual production situations. Rhoads, U.S. Pat. No. 4,854,164, shows a dual tank structure wherein dual tanks are connected by diverter lines. Flow between the tanks is governed by electronically controlled, pneumatically actuated valves. Electronic level indicators or float switches in the respective tanks provide signals that represent the volume in the tanks. An electronic controller uses the valves to fill the respective tanks one at a time. The tanks each accumulate production volumes from multiple strokes of a pumping unit. The electronic controller receives signals from the level indicator within a tank as the tank is filled, and causes electronically-controlled pneumatically-actuated valves in the diverter lines to switch the incoming fluid supply between the respective tanks, in order to purge the filled tank at an appropriate time. A conduit connects the two tanks to permit production gas passage between the two tanks, but the reason for this exchange is unclear. The electro-pneumatic valves and level indicators are subject to failure, and the electronic controller is instructed to open all valves if failure occurs, in order that the well may continue to produce. Even so, this remedial action may not be possible when the valves have failed.

There remains a true need for a reliable volumetric method and apparatus for controlling a beam pumping unit to avoid establishing a pumped-off condition in producing oil wells.

SOLUTION

The present invention overcomes the above-identified problems by providing method and apparatus for controlling a beam pumping unit through the use of a Coriolis flow meter to avoid establishing a pumped-off condition in a producing oil well. The Coriolis flow meter is particularly well-suited to the task because it has an exceptional sensitivity to flow rate, which is used to detect a drop in volumetric pump stroke efficiency corresponding to a pumped-off condition in a well bore.

The present invention involves a pump control system for use in avoiding actuation of a beam pumping unit while fluid levels in a well bore are disadvantageously low. The control system includes a flow meter (preferably a Coriolis flow meter) for measuring a production fluid volume produced by each upstroke of a beam pumping unit, or by averaging these volumes over time. The meter provides production signals representing the production fluid amount corresponding to the volumes produced by the pumping unit, and transmits these production signals to a central processing unit. The central processing unit receives the production signals and compares their corresponding representative production amounts against one another to identify a reduction in volumetric pump stroke efficiency induced by the establishment of a pumped-off condition in the well bore. The pumped-off condition occurs when an upper limit of production fluids in the well bore has fallen below a plunger assembly attached to the beam pumping unit. In turn, the central processing unit transmits a signal indicating that the pumped-off condition exists. A system controller acts upon receipt of this signal from the central processing unit to stop surface production from the beam pumping unit and permit buildup of bottom hole pressure in the well bore.

In preferred embodiments, the control system stops production from the pumping unit by selecting one of two options. As a preferred option, the control system ceases actuation of the pumping unit. In other circumstances, it is sometimes not practical to cease actuation of the pumping unit when the well is producing significant amounts of sediment in combination with the production fluids because the sediments tend to settle out of the production fluids and deposit in locations that cause damage to the pumping system. An expensive work-over operation could be required to overcome the effects of sediments settling out of the production fluids because the sediments can cause binding or scratching of the downhole pumping system components. In this latter circumstance, the control system preferably continues to permit actuation of the pump, but diverts surface production back into the well bore. Thus, fluid recirculation keeps sediments suspended in the production fluids until the fluids can be produced for market.

It is particularly preferred to use a Coriolis flow meter for conducting flow measurements. Coriolis flow meters can detect both forward and reverse flow. Reverse flow indicates that certain valves, namely, the check valve and standing valve, have failed. Additionally, the volume (corrected for temperature and pressure variations) that is produced by each pump stroke under normal operating conditions should equal the diameter of the production tubing string surface area of the pump plunger. If the produced fluid volume is less than this amount, the reduced volume indicates either a tubing leak or a leak in the traveling valve. The use of a Coriolis flow meter permits these determinations to be programmed into the central processing unit. In contrast, a simple dynamometer pumping system, which requires very complex manipulations of the pump apparatus to reach the same determinations that are readily available from Coriolis data. Regular turbine meters and positive displacement meters will not work as well in place of Coriolis flow meters because the displacement meters tend to clog (especially on reverse flow) and lack the sensitivity and reliability of Coriolis flow meters. Some turbine meters also tend to clog on reverse flow, and this class of meter is also very fragile and easily damaged under field operating conditions. Turbine meters also rely upon an estimate of fluid density that is assumed to be constant. This assumption produces inherent error because actual fluid density changes from pump stroke to pump stroke depending upon the mixture of oil and water in the production fluid.

Other salient features, objects, and advantages will be apparent to those skilled in the art upon a reading of the discussion below in combination with the accompanying drawings.

BRIEF DESCRIPTION OF THE DRAWINGS

FIG. 4 depicts a bottom hole pump assembly in which a pumped-off condition has been established;

FIG. 5 depicts a plurality of voltage signals supplied by the Coriolis flow meter of FIG. 3 to the computerized pump control unit enabling the computerized control unit to detect the pumped-off condition of FIG. 4;

FIG. 6 depicts an alternative method by which the computerized pump control unit of FIG. 3 can detect the pumped-off condition of FIG. 4;

DETAILED DESCRIPTION OF THE PREFERRED EMBODIMENT

Surface Features of the Pump Control System

Figure 3:
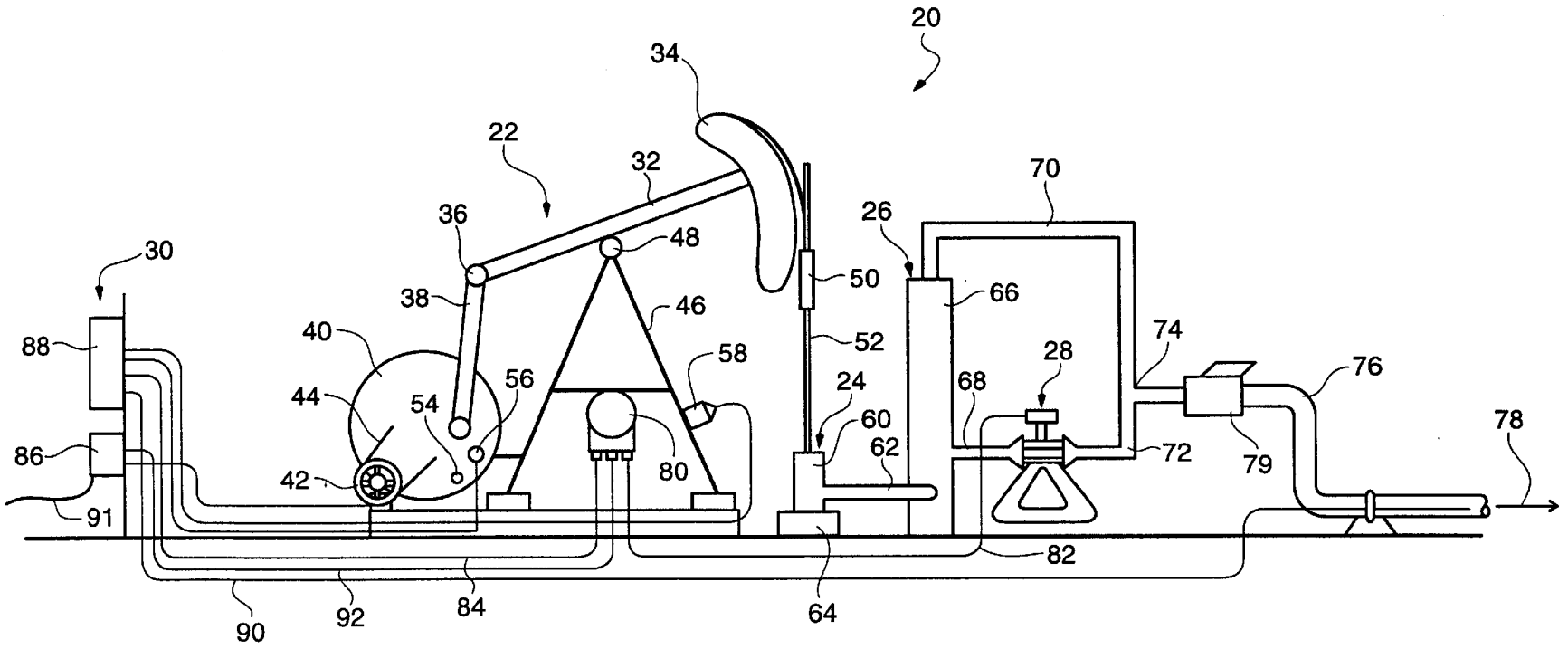
FIG. 3 depicts a pumping unit control system including a Coriolis flow meter and a computerized pump control unit according to the present invention.

FIG. 3 depicts a pump control system 20 according to the present invention. Control system 20 includes a conventional beam pumping unit 22, a wellhead 24 through which pumping unit 22 extracts production fluids, a gas eliminator 26 for separating produced gas from the production fluids, a Coriolis flow meter 28, and an automated control center 30 that governs the operations of control system 20 in response to measurements conducted by Coriolis flow meter 28.

Beam pumping unit 22 is a conventional pumping unit, and is schematically depicted to represent any type of reciprocating surface pumping unit. In industry parlance, the major components of pumping unit 22 include a walking beam 32 connecting a horse head 34 and an equalizer bearing 36. A pair of Pitman arms 38 connect the equalizer bearing 36 with a counter weighted crank 40. An A-frame structure 46 known as a Samson post supports walking beam 32 at center pivot 48. A wireline hanger and carrier bar assembly 50 couples horse head 34 with polished rod 52. A magnet 54 is mounted on crank 40, and sensor 56 is used to detect or count the rotation of magnet 54. Accelerometer 58 is used to detect low frequency vibrations in Samson post 46.

In operation, crank 40 rotates to cause a corresponding rotation of Pitman arms 38. The rotation of Pitman arms 38 reciprocates walking beam 32 up and down using center pivot 48 as a fulcrum point. The movement imparted to walking beam 32 at equalizer bearing 36 is reflected by corresponding opposed movement across walking beam 32 at horse head 34. In turn, horse head 34 imparts vertical reciprocating motion to polished rod 52 thorough wireline hanger and carrier bar assembly 50.

Wellhead 24 is a conventional wellhead including a sleeve 60 that receives materials for packing against polished rod 52 to eliminate leaks between polished rod 52 and sleeve 60. Sleeve 60 is positioned above flow diverter 62 leading to gas eliminator 26. Wellhead 24 is bolted to a production tubing and casing hanger 64 that is used to hang in tension very long strings of tubular goods inserted into the well bore (not depicted in FIG. 3).

Gas eliminator 26 includes a baffled upright cylinder 66 having interior flow spaces connecting flow diverter 62 with meter liquid inflow line 68 and upper gas loop 70. Liquid meter output line and upper gas loop 70 merge to form a T 74 at an elevation above Coriolis flow meter 28. Production line 76 carries production fluids from T 74 to a production fluid separator system (not depicted) in the direction of arrow 78. Check valve 79 assures that flow through production line 76 occurs only in the direction of arrow 78. Thus, gas is separated from the production fluids flowing through diverter line 62 by the action of baffled upright cylinder 66. Liquids go to Coriolis flow meter 28 through meter liquid inflow line, and gasses bypass meter 28 through upper gas loop 70.

Coriolis flow meter 28 is installed between meter liquid input line 68 and liquid output line 72. Coriolis flow meter 28 is preferably a commercially available Coriolis flow meter, such as the ELITE Model CMF100M329NU and Model CMF100H531NU which are available from Micro Motion of Boulder, Colo. These flow meters are also capable of operating as densitometers. Thus, a volumetric flow rate can be calculated by dividing the total mass flow rate by the total density measurement. Coriolis flow meter 28 uses electrical signals to communicate with Coriolis transmitter 80 over line 82. In turn, transmitter 80 uses electrical signals to communicate with automated control center 30 over line 84. A preferred form of transmitter 80 is the ELITE Model RFT9739, which is available from Micro Motion of Boulder, Colo. Meter 28 continuously measures the amount of flow of liquids through meter liquid inflow line 68, and transmits signals representing the flow amounts to automated control center 30 through transmitter 80.

Automated control center 30 includes a high voltage power supply 86 and an operations control unit 88, which includes a central processing unit together with program memory and drivers for electronically controlling the operation of remote systems. Control unit 88 is preferably the Model ROC306 from Fisher Industries of Marshalltown, Iowa. The central processing unit and program memory of control unit 88 is programmed to facilitate the implementation of control instructions through control unit 88, which transmits production data signals to a central field data gathering system (not depicted) on line 90. High voltage power supply 86 receives power over power source line 91, and distributes this power as needed to the components of system 20, e.g., to Coriolis transmitter 80 on line 92.

Detailed Description of the Pumped-Off Condition to be Avoided

FIG. 4 depicts a bottom hole assembly 100 that is connected to control system 20. A well bore 102 has been drilled through thousands of feet of geologic strata forming a portion of the earth's crust. One of these strata includes a producing reservoir 104 having porosity that is filled with production fluids including oil, water, and gas. Metal casing 106 is made of a plurality of threadably coupled tubes inserted into well bore 102. Casing 106 rises to the surface, and hangs in tension from tubing and casing hanger 64 (see FIG. 3). The space between casing 106 and well bore 102 is filled with cement 110 to prevent production fluids from channeling behind casing 106 and to isolate reservoir 104. Production tubing 108 hangs freely within casing 106 from tubing and casing hanger 64. Shaped explosive charges have been used to blast a plurality of perforations, e.g., perforations 112 and 114, through casing 106 and cement 110 to permit production fluids 116 from reservoir 104 to flow into casing 106. A packer 118 seals production fluids 116 within casing 106 beneath perforations 112 and 114.

A plurality of threadably interconnected, elongated, cylindrical members form a sucker rod string 120 connecting polished rod 52 (see FIG. 3) with plunger 122. Hollow cylindrical plunger 122 is circumscribed by a plurality of elastomeric seals, e.g., seal 124, that compressively engage the inner diameter of production tubing 108 with sufficient force to lift a column 126 of production fluids within production tubing 108. The lower portion of plunger 122 includes a ball valve and seat assembly 128 (i.e., the traveling valve) that seals under the weight of production fluid column 126. Perforations 130 in the upper portion of plunger 122 permit the flow of production fluids between the hollow interior of plunger 122 and fluid column 126. The lower portion of production tubing 108 includes a ball valve and seat assembly 132 (i.e., the standing valve) that seals under the compressive forces created by the downstroke of plunger 122, and opens to permit the entry of production fluids 116 into production tubing 108 under the relative vacuum created by the upstroke of plunger 122.

As depicted in FIG. 4, a pumped-off condition has been established within bottom hole assembly 100. An average pressure P exists within reservoir 104. The flow of production fluids into casing 106 has created a pressure drawdown gradient along arrow 134 in the portion of reservoir 104 surrounding well bore 102 such that the volume of production fluids flowing into casing 106 through perforations 112 and 114 is insufficient to meet the rate at which the reciprocation of plunger 122 is removing fluids from within casing 106. Therefore, production fluids 116 have an upper fluid level 136. Plunger 122 reciprocates in the direction of arrow 138 by the action of horse head 34 (see FIG. 3) upon polished rod 52 through sucker rod string 120. Plunger 122 is depicted at the full extent of its upward travel. The upward travel of plunger 122 has exerted a relative vacuum on production fluids 116 to open ball valve and seat assembly 132 for the transfer of production fluids 116 into production tubing 108. The vacuum exerted by plunger 122 upon production fluids 116 has caused the production fluids to release or flash gas, which creates a gas-filled space 139 between plunger 122 and fluid level 136. Gas also enters production tubing 108 to form gas-filled space 139 when the upstroke of plunger 122 causes uppermost fluid level 136 to fall below ball valve and seat assembly 132.

Plunger 122 is beginning to descend towards production fluids 116 at fluid level 136 through the gas-filled space 139. Ball valve and seat assembly 128 is sealed under the weight of fluid column 126 to prevent the leakage of production fluids in column 126 into gas-filled space 139. Plunger 122 travels downwardly until ball valve and seat assembly 128 slams into production fluids 116 at fluid level 136 to create a fluid pound effect that is transferred up to pumping unit 22 (see FIG. 3) through sucker rod string 120. Ball and seat valve assembly 132 seals under the compressive forces created by the impact of plunger 122 against production fluids 116 at level 136. The continued downward travel of plunger 122 opens ball valve and seat assembly 128 through the compressed fluid forces against ball valve and seat assembly 132 to permit production fluids 116 to flow across ball valve and seat assembly 128, through the hollow interior of plunger 122, through perforations 130, and into production fluid column 126. A subsequent upstroke of plunger 122 seals ball valve and seat assembly 128 and opens ball valve and seat assembly 132 for repetition of the pumping cycle.

The fluid pound of plunger 122 against production fluids 116 at fluid level 136 is extremely undesirable for several reasons. Over time, a repeated fluid pound effect of this type fatigues sucker rod string 120 to cause a mechanical failure. This mechanical failure is very costly because the broken sucker rod string must be fished out of well bore 102 and replaced. The consequences of a sucker rod string breakage may compound upon one another with the effect that the well must be abandoned because repairs are no longer economically feasible. For example, the collapsed sucker rod string 120 may cause a corresponding failure in the production tubing 108, or sediments may settle from the production fluid column 126 onto plunger 122 making it impossible to extract the collapsed sucker rod string during repair operations. Additionally, the need for repair induces production downtime during which no revenues are derived from the well.

Furthermore, the operation of pumping unit 22 (see FIG. 3) becomes increasingly less efficient as the gas space 139 within production tubing 108 increases. The volume of production fluids 116 that should be displaced with every pump upstroke equals the surface area of production tubing 108 taken across its inner diameter in a direction perpendicular to its axis of elongation times the length of the upstroke for plunger 122. The presence of gas-filled space 139, however, only permits the entry of production fluids 116 into plunger 122 beginning at level 136. When the gas-filled space 139 occupies about half of the volume of production fluids 116 that should be entering plunger 122 on its downstroke, volumetric pump efficiency falls to about one-half of its design output. Energy costs remain constant because it requires about the same amount of energy for pumping unit 22 to reciprocate production fluid column 126 and sucker rod string 120 along arrow 138. Thus, energy costs remain constant while the amount of production falls, and the amount of energy expended per unit production volume increases. In marginal wells, the resultant inefficiency and increased costs can necessitate abandonment of the well for economic reasons if corrective action is not taken.

Avoiding the Pumped-Off Condition

The solution to the pumped-off condition depicted in FIG. 4 is to cease lifting of production fluids 116 for a sufficient period of time to permit a reduction or elimination of the pressure drawdown gradient within reservoir 104 along arrow 134, i.e., the well needs to be temporarily shut-in.

When production is resumed, the increased bottom hole pressure at well bore 102 is sufficient to raise level 136 to a position above the uppermost point of travel for plunger 122. Even so, production eventually must again be shut-in because the available reservoir energy is insufficient to meet the production rate demands of plunger 122 at a given pump reciprocation rate. Those skilled in the art are aware that the overall production rate from well bore 102 can be optimized by attempting to fine-tune the operation of pumping unit 22 through operating it a rate that establishes a level 136 within casing 106 which comes very close to a pumped-off condition without actually establishing the condition. The exact nature of the adjustments to pumping unit operational parameters are normally determined by skilled persons in the field by adjusting parameters including the rate of reciprocation for plunger 122, the duration of shut-in time, and the duration of pumping time. Design and operational considerations for pumping units have been the subject of extensive literature, e.g., *API Specification for Pumping Units,* 12th edition, API Specification IIE, API, Dallas (January 1982) (a publication of the American Petroleum Institute). In traditional practice, the optimal shut-in or idle time is the minimum time of no net production that permits the pumping unit to produce for substantially equal intervals which are interspersed between each period of idle time without pumping off.

By way of example, an operator may program controller 88 to change the idle time between pumping intervals from thirty minutes to fifteen minutes. Following this program change, the well may produce fifty barrels of oil and water in a first production interval before it pumps off and must again be idled to allow reservoir pressure to build up. A second pumping interval may produce forty barrels before the well must be idled, and a third interval may produce thirty barrels. In this example, the consistent decline in production is an indicator that the idle time needs to be increased, or the rate of pump reciprocation needs to be slowed. In practice, these changes are made according to field experience, with initial guesses being made according to analogies to nearby wells. In the event that no nearby wells are available, the operator may make an initial guess based upon his or her experience, or the operator may follow guidelines suggested by API or other standard engineering calculations.

FIG. 5 depicts a preferred method that control unit 88 uses to monitor or compare production volumes which are lifted to the surface by each reciprocation cycle of plunger 122 for the purpose of determining when pumping operations have established a pumped-off condition similar to that depicted in FIG. 4. Coriolis flow meter 28 (see FIG. 3) measures the mass flow rate and density of production fluids 116 (see FIG. 4) that have been lifted to the surface by the reciprocating action of plunger 122. Coriolis flow meter 28 transmits signals representing of these mass flow rates and densities to Coriolis transmitter 80 on line 82. In turn, Coriolis transmitter 80 processes the signals received from Coriolis flow meter 28 to obtain a volumetric calculation by dividing the mass flow rate by the corresponding density value, and transmits the calculation results as voltage pulses to control unit 88 over line 84.

Figure 1:
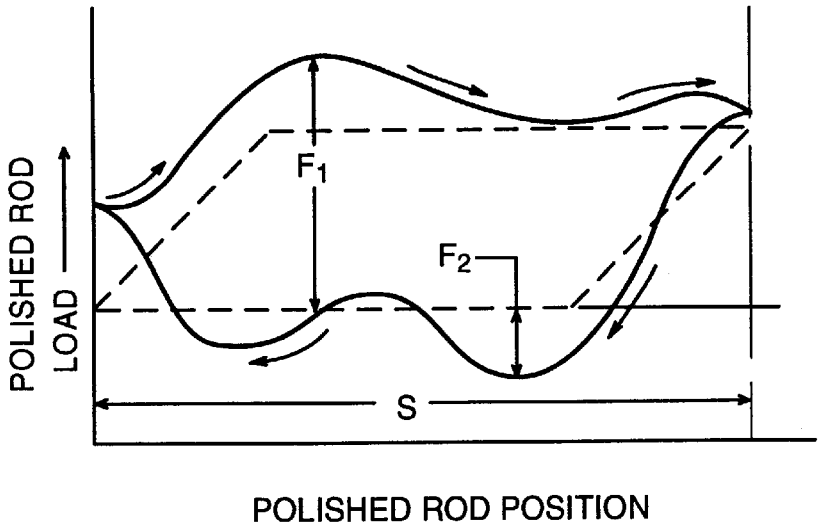
FIG. 1 PRIOR ART
FIG. 1 depicts a dynamometer card representing a prior art method of monitoring the operation of a beam pumping unit.
Figure 2:
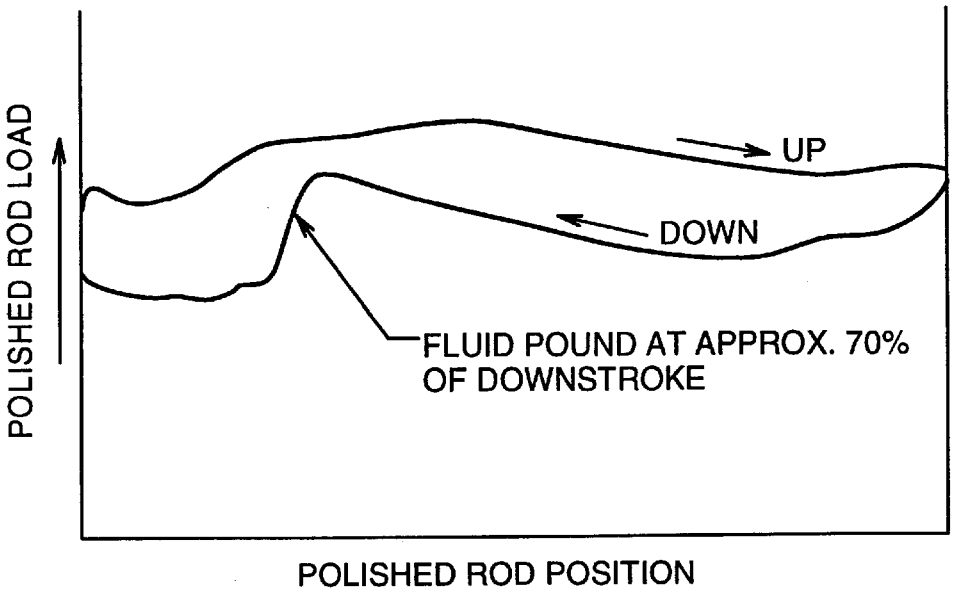
FIG. 2 PRIOR ART
FIG. 2 depicts a prior art dynamometer card showing the effects of fluid pound indicating that a pumped-off condition has been established in the well bore.

FIG. 5 depicts these voltage pulses for a plurality of successive pump cycles 150, 151, and 152. Each pump cycle includes a corresponding pump upstroke 153, 155, or 157, of plunger 122 (see FIG. 4) and corresponding downstroke 154, 156, 158. Each upstroke is associated with the greatest production volume, which is represented by a plurality of uniform voltage pulses, e.g., pulse 159, which cumulatively indicate the volume produced in each pump reciprocation cycle as indicated to controller 88 by magnet 54 and detector 56 (see FIG. 1). Coriolis meter 28 and transmitter 80 record volumetric production even during downstrokes, such as pulse 160 of downstroke 154, because baffled cylinder 66 acts as an accumulator during the upstrokes (e.g., upstroke 153) to retain additional volume under high flow rate conditions that eventually passes through Coriolis meter 28 under low flow conditions. For example, FIG. 5 depicts thirty-seven pulses counted in upstroke 153 followed by three pulses during downstroke 154 to provide a total of forty pulses in reciprocation cycle 150. Similarly, reciprocation cycle 151 counts twenty-nine pulses, and reciprocation cycle 152 counts twenty-three. Each pulse represents a predetermined amount of volume, e.g., 0.2 gallons. Thus, controller 88 compares the sequential drop in efficiency against the volumetric flow corresponding to the initial upstroke 153, i.e., a twenty-eight percent drop from cycle 150 to cycle 151, and forty-three percent from cycle 150 to cycle 152.

Control unit 88 is programmed to cease actuation of pumping unit 22 when the pump efficiency falls below a threshold level or value. The operator selects this level, and enters it as a cutoff value that is stored by controller 88. In FIG. 5, the cutoff value is fifty percent efficiency. Thus, a decline to fifty percent or less lifting efficiency causes control unit to shut-in well bore 102 by depriving prime mover 42 of power. Control unit 88 has a timer, and resupplies prime mover 42 with power after an acceptable shut-in period. The duration of shut-in time can be calculated by conventional mathematical algorithms stored as program information in control unit 88, or the operator can enter a manual override in an attempt to optimize the production rate. Similarly, control unit 88 accepts the reciprocation rate of pump unit 22 as a control input feature.

FIG. 6 depicts another manner by which control unit 88 can compare or monitor production time-averaged volumes that are lifted to the surface by a plurality of plunger 122 reciprocation cycles for the purpose of determining when pumping operations have established a pumped-off condition similar to that depicted in FIG. 4. Controller 88 receives voltage pulses similar to those depicted in FIG. 5, and averages the corresponding production volumes for a plurality of reciprocation cycles over time. For example, a single point 161 on curve 162 can be the production volume of reciprocation cycles 150, 151, and 152 (see FIG. 5) divided by three. Alternatively, the respective cyclic production volumes may simply accumulated over time without averaging. This time-averaging method advantageously avoids situations where controller 80 may idle the well in due to spurious readings that may result from aberrant production conditions, such as the expansion of a gas bubble in the production tubing 108 (see FIG. 4). Thus, controller 80 does not compare the volume of individual strokes, but compares average volumes or accumulated volumes over a number of reciprocation cycles, as detected by magnet 54 and sensor 56. Periods of production 164, 166, 168, and 170 (i.e., when pumping unit 22 is reciprocating) are interspersed with periods when the well is shut-in or idled for pressure build-up 172, 174, and 176 (i.e., when pumping unit 22 is not reciprocating). As in production cycle 166, each production cycle begins at the highest average rate, and controller 88 initiates shut-in when the average production rate falls below a selected threshold value at rate 180, e.g., ninety-five percent of rate 178.

Figure 7:
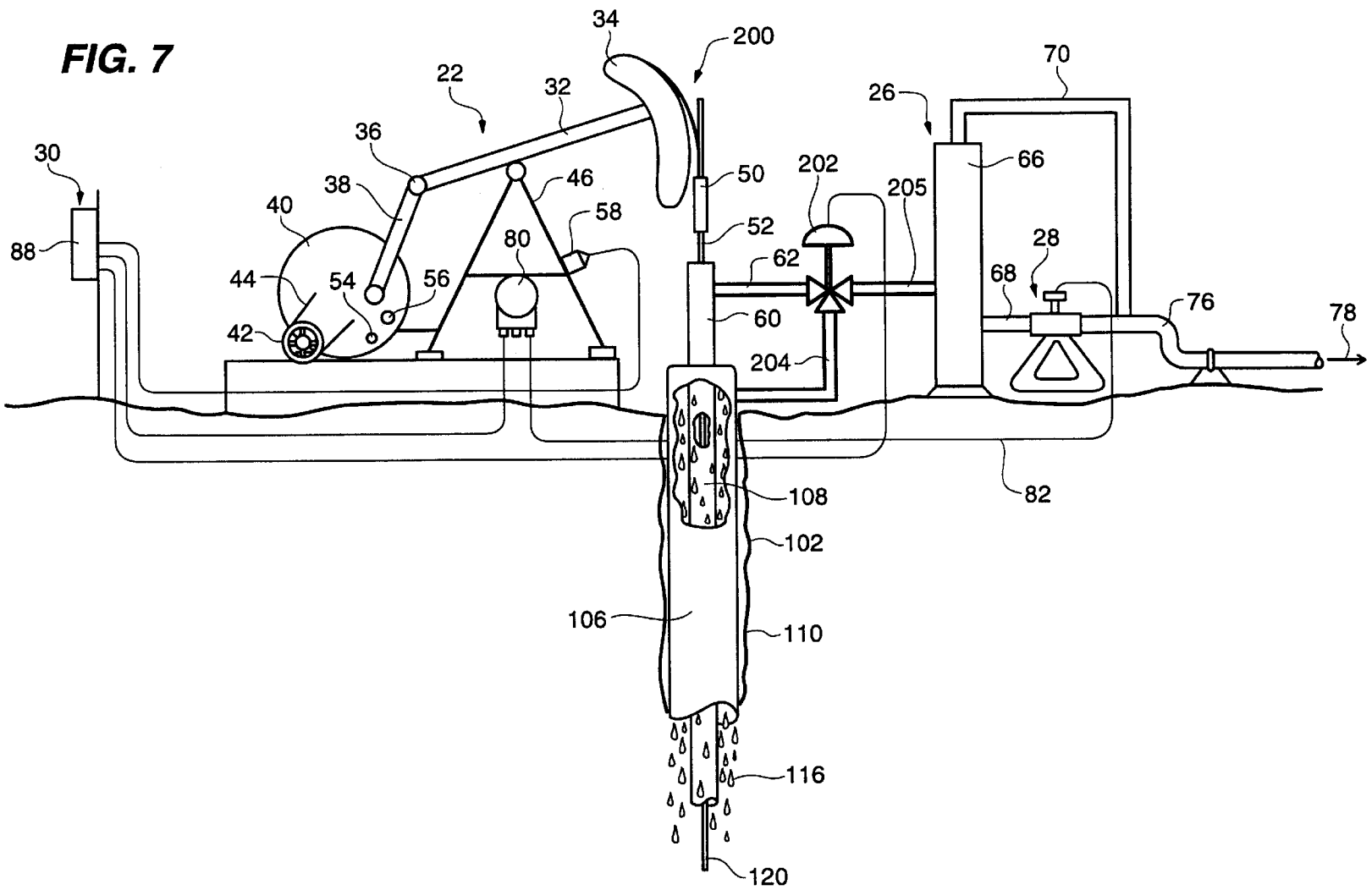
FIG. 7 depicts an alternative pump control system according to the present invention for use in wells that produce heavily sedimented production fluids.

Alternative Embodiment for Use in Wells That Produce Heavily Sedimented Fluids FIG. 7 depicts an alternative embodiment of pump control system 20, namely, pump control system 200 for use in wells where it is undesirable to cease the reciprocation of pumping unit 22. Identical numbering has been retained for features of the system 200 in FIG. 7 that are identical with respect to the features of pump control system 20 in FIGS. 3 and 4. The main difference between control system 20 and control system 200 is the addition of three-way valve 202 in diverter line 62. Three way valve 202 has two alternative configurations. In normal production operations, three-way valve 202 receives production fluids from flow diverter line 62, and transfers all of the fluids so received to gas eliminator 26 through tube 205. The second configuration of three-way valve 202 is to receive production fluids from flow diverter line 62 and transfer all fluids so received through return line 204 to the annulus between casing 106 and production tubing 108. Thus, all fluids produced from well bore 102 are recycled so that there is no net production from well bore 102. Alternatively, only a portion of the produced fluids may be recycled if the net production rate from the well still permits sufficient pressure build up to overcome the pump-off problem.

The advantage in establishing continuous motion in the production fluids while obtaining no net production is that the continuous motion maintains sediments within the production fluids 116 in suspension without affording the sediments a chance to settle. Without the continuous motion, sand or other mineral particles could settle around the plunger seals 124 (see FIG. 4) within tubing 108. In that position, the deposited mineral particles could necessitate a costly repair by locking plunger 122 in place or by scoring seal 124 as well as the portion of production tubing 108 proximal to seal 124.

An Alternative Embodiment—The Manifold Control System

Oil fields are often located in isolated rural areas, and can have an areal extent covering tens of square miles. An in-field pipeline system is often installed to gather production fluids from a plurality of widely dispersed well sites. In the gathering system, a tubing string connects a producing well to a manifold. Other wells are also connected to the manifold by other tubing strings. The manifold is used to selectively combine the production from various wells, and deliver the production to pre-sale processing facilities, such as a gas-oil separation plant. Thus, the manifold is located at a centralized sale facility that is regularly maintained and visited by operations personnel. On the other hand, the remote well sites receive less attention because costs would be greatly increased if it were necessary to employ operating personnel at each well site. Costwise, it is better to conduct as many operations as possible at the centralized pre-sale processing center proximal to the manifold.

Figure 8:
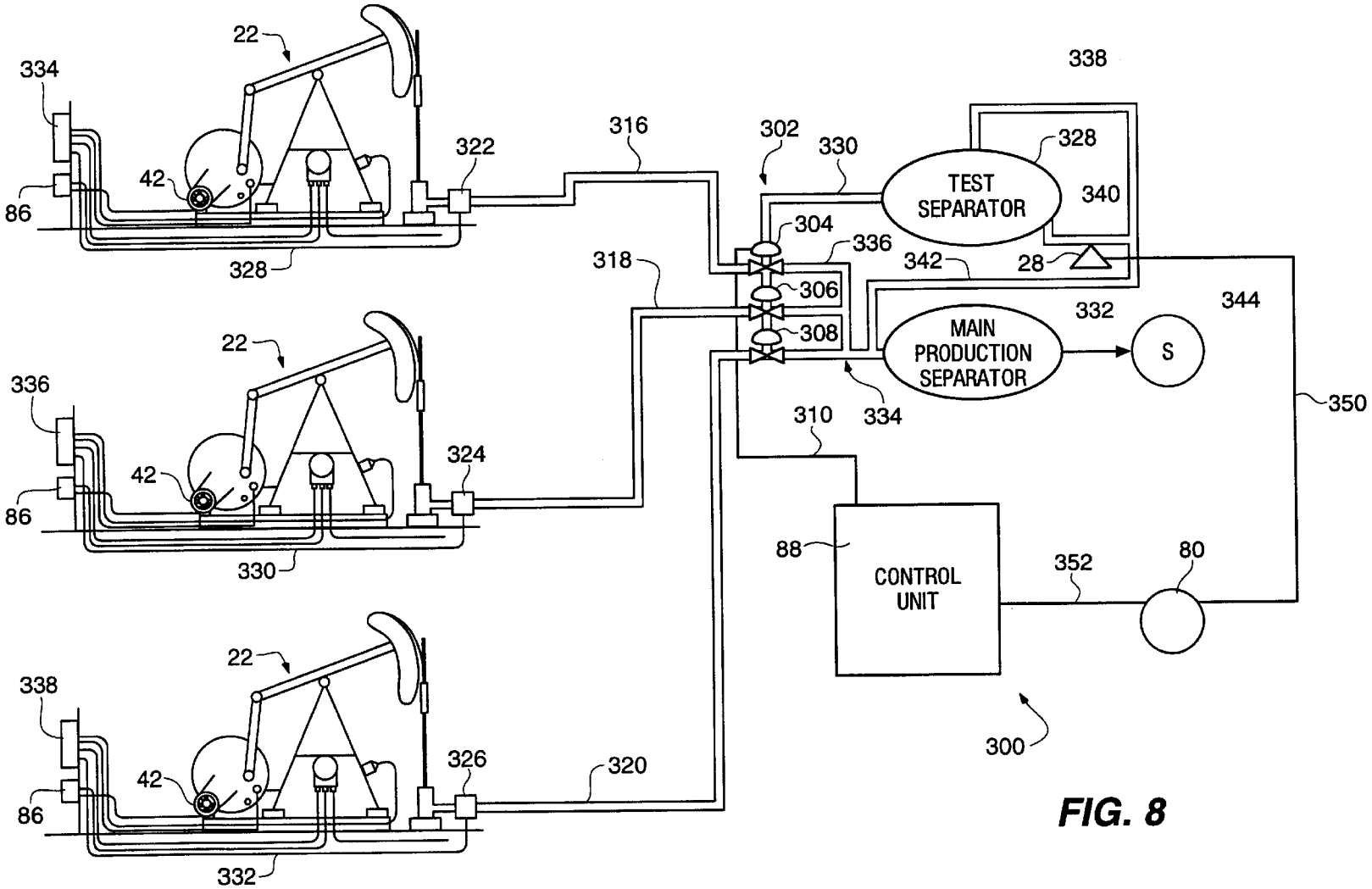
FIG. 8 depicts yet another pump control system according to the present invention for use in wells that produce fluids to central gathering stations with central measurement systems.

FIG. 8 depicts a third embodiment of the present invention, i.e., control system 300, which partially closes a manifold valve to provide a pressure signal commencing shut-in of a selected well. In FIG. 8, identical numbering has been retained for system components that are identical to system components of the FIG. 3 control system 20.

Control system 300 operates from a manifold 302, which includes a plurality of electronically controlled and pneumatically actuated valves 304, 306, and 308. Control unit 88 governs the operations of valves 304–308 through electrical signals transmitted on line 310. In association with each one of valves 304–308, a corresponding surface tubing string 316, 318, or 320 connects manifold 302 with a respective beam pumping unit 22. Each tubing string is provided with a corresponding pressure transmitter 322, 324, and 326. A signal transmission line, 328, 330, or 332, connects each pressure transmitter 322, 324, or 326, with a corresponding timer unit 334, 336, or 338. Manifold 302 preferably feeds a two-phase test separator 328 with production fluids through tubular line 330. Manifold 302 also feeds main production separator 332 through a gathering rail 334, which includes a plurality of tubular lines (e.g., line 336) corresponding to each valve on the manifold.

Test separator 328 preferably includes a gas bleed line 338 and a liquid drain line 340. A Coriolis flow meter 28 is mounted in liquid drain line 340 for volumetric measurement of liquid production fluids including oil and water flowing through liquid drain line 340. Gas bleed line 338 and liquid drain line 340 combine into line 342 to feed gathering rail 334 going into main production separator 332. Main production separator 332 is a conventional three phase (gas, oil, and water) separator that delivers salable fluids to a sales and delivery system 344.

In the operation of system 300, control unit 88 configures manifold 302 to flow all of the production fluids received from a single well corresponding to a single valve (e.g., valve 306) to test separator 328 through line 330. The remaining flow streams from valves 304–308 that are not flowing to test separator 328 are either shut-in or configured to flow into gathering rail 334 into main production separator.

As in other embodiments, Coriolis flow meter 28 provides mass flow rate and density measurement signals to Coriolis transmitter 80 in line 350. Control unit 88 receives volumetric signals from Coriolis transmitter 80 on line 352. Control unit 88 monitors and compares these signals to identify an appropriate shut-in time for the well on test, and proceeds to shut down a selected one of the respective pumping units 22 as required.

Control system 300 differs from other embodiments in the manner in which control unit 88 implements shut-in of the respective pumping units. When Coriolis measurements indicate that the well corresponding to tubing string 316 has established a pumped-off condition, control unit 88 causes valve 304 to partially close. The closing action of valve 304 induces a pressure rise or surge in tubing string 316. Pressure transmitter 322 detects this pressure rise, and transmits the measurement to timer 334. Timer 334 is programmed to deny power to the corresponding prime mover 42 when the pressure at transmitter 322 exceeds a maximum threshold value or maximum pressure rise rate, e.g., 200 psi. Thus, the increased pressure caused by the restriction of valve 304 operates as a signal causing timer 334 to shut-in production. Timer 334 reestablishes production by supplying power to the prime mover 42 after a predetermined amount of bottom hole pressure build-up time. Control unit 88 stores the elapsed pumping time to shut-in as program control data that will be used to operate the selected well when it is no longer on test.

Additional Advantages of Using a Coriolis Flow Meter

System leaks sometimes cause problems in pumping operations. The use of a Coriolis flow meter advantageously facilitates the diagnosis of these problems. Specifically, a combined failure or leak in the surface check valve 79 (see FIG. 3) and the ball valve and seat assembly 132 (the standing valve) causes a backflow of production fluids from the surface to reservoir 104 under the force of gravity. Coriolis flow meter 28 detects this backflow of production fluids, which typically occurs on the downstroke of plunger 122 or during idle time. Thus, control unit 88 is programmed to alert the operator whenever a backflow exists.

Other leaks can develop in the tubing or ball valve and seat assembly 128 (the traveling valve). In this circumstance, pump efficiency may not change from stroke to stroke (as would indicate a pumped-off condition), but pump efficiency is less than optimal. As indicated above, the volume of production fluids delivered by a pump upstroke should equal the cross-sectional area across the inner diameter of production tubing 108 times the length of travel on the upstroke of plunger 122 (see FIG. 4). Delivery of fluid amounts less than this volume indicates a leak in production tubing 108 or ball valve and seat assembly 128. Accordingly, control unit 88 is programmed to alert the operator to a potential leak whenever a reduced efficiency of this type is deduced from the measurements provided by Coriolis flow meter 28.

The Accelerometer

In addition to the use of the pump-off detection methods of FIGS. 5 and 6, control unit 88 also receives information from accelerometer 58 (see FIG. 3). Accelerometer 58 detects low frequency vibrations that derive from fluid pound associated with the reciprocation of pumping unit 22 in a pumped-off condition. Thus, the accelerometer data is available for use as a back-up indicator of the need to shut-in production in the event that tubing leaks or other mechanical problems preclude the use of flow measurement information from Coriolis flow meter 28 in identifying the existence of a pumped-off condition.

Program Features of Control Unit 80

Figure 9:
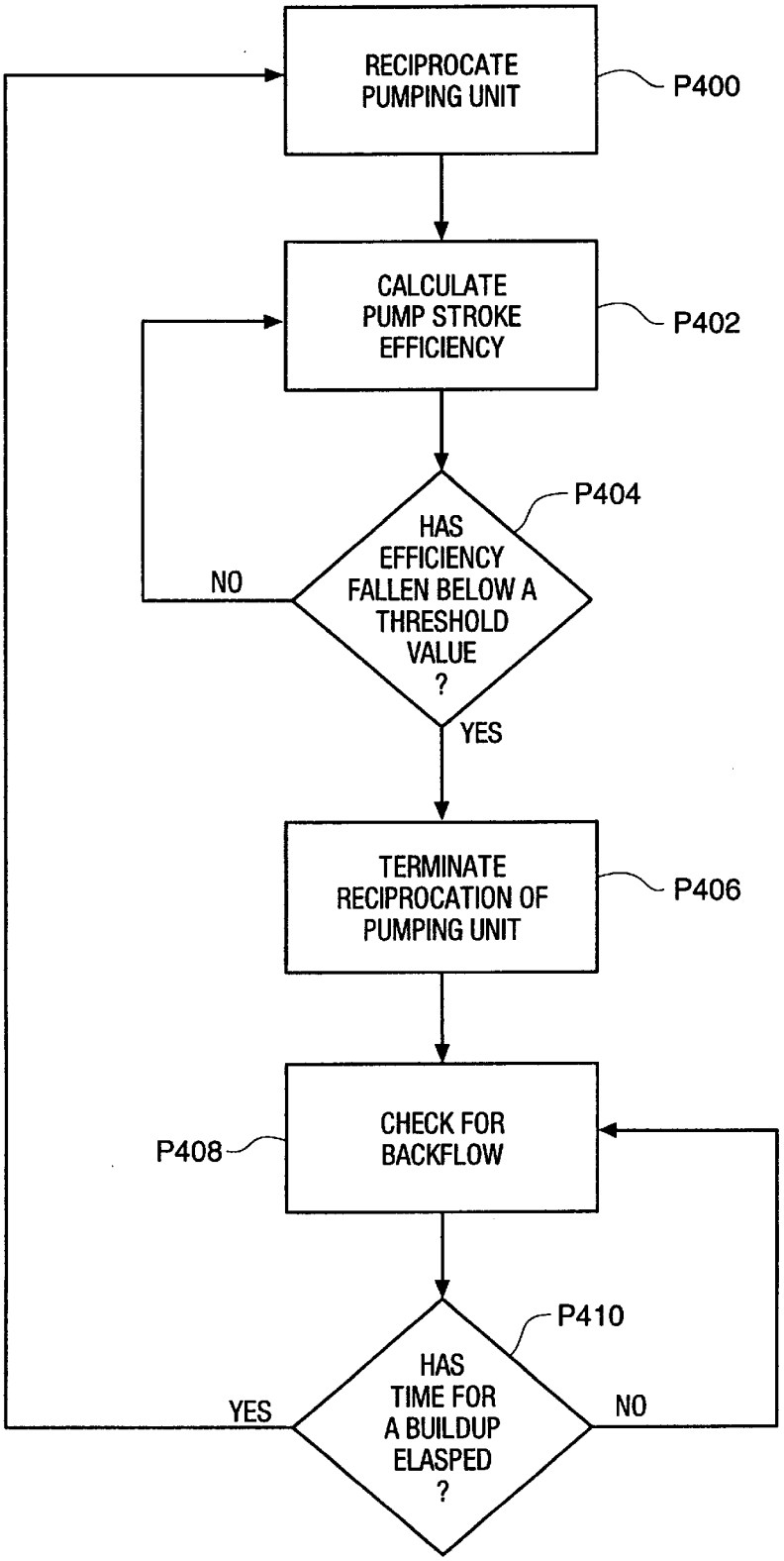
FIG. 9 depicts a schematic process control flow chart diagram governing the operation of the pump control system according to the present invention.

FIG. 9 schematically depicts program control features of control unit 88. These features govern the operation of control systems 20, 200 and 300. In step P400, control unit 88 causes pumping unit 22 (see FIG. 3) to begin reciprocating plunger 122. This reciprocation lifts production fluids to the surface in the conventional manner of all reciprocating pump units. Coriolis flow meter 28 measures the production volumes that are associated with each stroke cycle detected by magnetic sensor 56. Coriolis transmitter 80 processes these measurement signals, and transmits then to control unit 88.

In step P402, control unit 88 calculates the volumetric pump stroke efficiency indicated by the signals received from Coriolis transmitter 80. This calculation is preferably performed as a percentage difference calculation in the manner described above in association with FIG. 5 or FIG. 6. The percentage difference uses an initial or maximum pump stroke volume as the basis of comparison. The initial volume can be selected as the first volume, but is more preferably calculated as an average of the several cycles, e.g., the first five stroke cycles. Alternatively, the initial value can be selected as a maximum value for each pumping session. This averaging technique or the selection of a maximum value is useful because systematic leaks in the production system may necessitate the filling of the pumping system with production fluids before a maximum pumping volume can be obtained. In step P404, control unit 88 compares the stroke efficiency of the most recent stroke cycle (e.g., one upstroke and one downstroke or an average value of the last three upstrokes and three downstrokes) against a threshold value that is preferably given to control unit 88 as program data input by the operator. If the efficiency has not fallen below the threshold value, pump reciprocation continues, and step P402 calculates a new efficiency. A decline in strokes efficiency indicates that a pumped-off condition has been established in the well. Accordingly, when step P404 diagnoses this condition as an efficiency below the threshold value, control unit 88 causes pumping unit 22 to terminate reciprocation in step P406, i.e., the well is shut-in.

In step P408, Coriolis flow meter 28 continues to measure production mass flow rates even though there is no positive flow of production fluids originating from the reciprocation of pumping unit 22. Step P408 alerts the operator that a check valve and standing valve leak exists if Coriolis meter 28 detects a backflow of production fluids during the shut-in period.

In step P410, a timer in control unit 88 (or a timer unit associated with control unit 88) determines whether a period of time has elapsed to permit a sufficient pressure buildup in reservoir 104. The buildup time can be calculated according to a variety of conventional engineering methods including exponential integral calculations, type curve analysis, procedures established by the American Petroleum Institute, or operator input data. If the timer indicates that the pressure buildup period is not sufficient, Coriolis flow meter continues to monitor for backflow in step P408. When the buildup period has elapsed, control unit again causes pumping unit 22 to reciprocate in step P400.

Those skilled in the art will understand that the preferred embodiments, as hereinabove described, may be subjected to apparent modifications without departing from the true scope and spirit of the invention. The inventor, accordingly, hereby states his intention to rely upon the Doctrine of Equivalents, in order to protect their full rights in the invention.

I claim:

1. A pump control system for use in terminating actuation of a pumping unit while fluid levels in a well bore are disadvantageously low, said system comprising:

means for measuring a production fluid volume corresponding to the reciprocation of a reciprocating pump unit;

means for producing signals representative of said production fluid volume corresponding to each of said stroke cycles;

means responsive to receipt of said signals for comparing said production fluid volumes to identify a reduction in pump stroke lifting efficiency;

means for generating a signal representative of said reduction in pump stroke efficiency; and means responsive to said generation of said signal representative of said reduction in pump stroke efficiency for stopping surface production from said pumping unit, wherein said measuring means includes a Coriolis flow meter.

2. The system as set forth in claim 1 wherein said stopping means includes means for delaying actuation of said pumping unit over a sufficient period of time to permit bottom hole pressure to build up in said well bore.

3. The system as set forth in claim 1 wherein said stopping means includes means for reintroducing surface production to said well bore to prevent deposition of sediment on downhole pump system components.

4. The system as set forth in claim 1 wherein said stopping means includes a manifold providing means for increasing pressure on said well's flow line.

5. The system as set forth in claim 4 wherein said stopping means includes means responsive to said increased pressure for ceasing actuation of said pumping unit.

6. The system as set forth in claim 1 including means for adjusting pump operation parameters selected from a list consisting of pump strokes per unit time, shut-in time, and pumping time.

7. The system as set forth in claim 1 including means for detecting a problem selected from a group consisting of a check valve leak and a standing valve leak.

8. The system as set forth in claim 7 wherein said detecting means includes means for producing signals representative of a backflow of produced fluids into said well bore.

9. The system as set forth in claim 1 including means for analyzing said signals to identify a problem selected from a group consisting of a tubing leak and a traveling valve leak.

10. The system as set forth in claim 1 wherein said measuring means includes means for calculating said production volume by dividing a mass flow rate by a density value corresponding to said mass flow rate.

11. The system as set forth in claim 1 wherein said comparing means includes means for calculating a difference between successive ones of said signals.

12. A method of controlling a pumping unit to avoid actuation of the pumping unit while fluid levels in a well bore are disadvantageously low, said method comprising the steps of:

measuring a production fluid volume produced by a pumping unit through the use of a Coriolis flow meter;

producing signals representative of said production fluid volume corresponding to each upstroke of said pumping unit;

comparing said signals between one another to identify a reduction in volumetric pump stroke efficiency induced by an upper limit of production fluids in said well bore having fallen below a plunger assembly attached to said pumping unit;

transmitting a signal representative of said condition; and stopping surface production from said pumping unit to permit buildup of bottom hole pressure in said well bore.

13. The method as set forth in claim 12 wherein said stopping step includes a step of delaying actuation of said pumping unit over a sufficient period of time to permit bottom hole pressure to build up in said well bore.

14. The method as set forth in claim 12 wherein said stopping step includes a step of reintroducing surface production to said well bore to prevent deposition of sediment on downhole pump system components.

15. The method as set forth in claim 12 wherein said stopping step includes a step of using a manifold to increase pressure on said well's flow line.

16. The method as set forth in claim 15 wherein said stopping step includes a step of responding to said increased pressure by ceasing actuation of said pumping unit.

17. The method as set forth in claim 12 including a step of adjusting pump operation parameters selected from a list consisting of pump strokes per unit time, shut-in time, and pumping time.

18. The method as set forth in claim 12 including a step of detecting a problem selected from a group consisting of a check valve leak and a standing valve leak.

19. The method as set forth in claim 18 wherein said detecting step includes a step of producing signals representative of a backflow of produced fluids into said well bore.

20. The method as set forth in claim 12 a step of analyzing said signals to identify a problem selected from a group consisting of a tubing leak and a traveling valve leak.

21. The method as set forth in claim 12 wherein said measuring step includes calculating a volumetric flow rate by dividing a mass flow rate by a density value corresponding to said mass flow rate.

22. The method as set forth in claim 12 wherein said comparing step includes a step of calculating a difference between successive ones of said signals.

* * * * *